US008761973B2

(12) United States Patent
Schneider et al.

(10) Patent No.: US 8,761,973 B2
(45) Date of Patent: Jun. 24, 2014

(54) SUSPENSION FAILURE DETECTION IN A RAIL VEHICLE

(75) Inventors: Richard Schneider, Löhningen (CH); Mike Baert, Sint-Andries (BE)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 13/388,117

(22) PCT Filed: Sep. 15, 2010

(86) PCT No.: PCT/EP2010/063563
§ 371 (c)(1),
(2), (4) Date: Jun. 20, 2012

(87) PCT Pub. No.: WO2011/032991
PCT Pub. Date: Mar. 24, 2011

(65) Prior Publication Data

US 2013/0018535 A1 Jan. 17, 2013

(30) Foreign Application Priority Data

Sep. 15, 2009 (GB) ..... 0916172.0

(51) Int. Cl.
*G06F 17/00* (2006.01)

(52) U.S. Cl.
USPC ..... 701/19

(58) Field of Classification Search
USPC ..... 701/19
See application file for complete search history.

(56) References Cited

U.S. PATENT DOCUMENTS

| | | | | |
|---|---|---|---|---|
| 3,720,175 | A * | 3/1973 | Russell-French | 105/224.1 |
| 5,035,406 | A * | 7/1991 | Sellers et al. | 267/48 |
| 5,384,706 | A * | 1/1995 | Uchiyama et al. | 701/37 |
| 6,427,812 | B2 * | 8/2002 | Crawley et al. | 188/266.7 |
| 2009/0283942 | A1 * | 11/2009 | Nakamura | 267/64.13 |

FOREIGN PATENT DOCUMENTS

| | | | |
|---|---|---|---|
| DE | 19837486 | A1 | 2/2000 |
| JP | 200071982 | A | 3/2000 |
| JP | 200940078 | A | 2/2009 |
| JP | 200973418 | A | 4/2009 |
| WO | 0181147 | A1 | 11/2001 |

OTHER PUBLICATIONS

Machine Translation of JP 2000-071982, Mar. 7, 2000.*

* cited by examiner

*Primary Examiner* — Mary Cheung
*Assistant Examiner* — Anne Mazzara
(74) *Attorney, Agent, or Firm* — The Webb Law Firm

(57) ABSTRACT

The invention relates to a rail vehicle, including a wagon body and a suspension system having a running gear supporting the wagon body. A sensor device and a control device are provided. The sensor device capturing an actual value of at least one status variable being representative of a spatial relationship between a first reference part of the sensor device associated to a part of the running gear and a second reference part of the sensor device associated to the wagon body. The control device performs a malfunction analysis using the actual value of the status variable, the malfunction analysis assessing fulfillment of at least one predetermined malfunction criterion. The control device provides a malfunction signal if the malfunction analysis reveals that the malfunction criterion is fulfilled.

15 Claims, 4 Drawing Sheets

SUSPENSION FAILURE DETECTION IN A RAIL VEHICLE

BACKGROUND OF THE INVENTION

1. Field of the Invention

The present invention relates to a rail vehicle comprising a wagon body and a suspension system with a running gear supporting the wagon body. The present invention further relates to a method for detecting malfunction in a suspension system of such a rail vehicle.

2. Description of Related Art

In modem rail vehicles it is generally known to detect malfunctions within the suspension system of the rail vehicle which have an adverse effect on the running stability of the rail vehicle. Typically, vibration sensors or the like are used to capture actual values of status variables representative of the accelerations acting on specific component of the suspension system of a vehicle. The data obtained in this way are then analyzed in order to detect situations with excessive accelerations acting within the suspension system which are representative of a malfunction of the suspension system. If such a malfunction situation is detected, corresponding malfunction warning signals are issued in order to initiate appropriate countermeasures to avoid hazardous situations. Such systems are for example known from WO 01/81147 A1.

However, during operation of a rail vehicle unacceptable and potentially hazardous situations may not only result from an inappropriate vibrational behavior of the running gear of the vehicle. For example, excess lateral movements of the wagon body with respect to the running gear may lead to a violation of the kinematic envelope defined for the specific track the vehicle is negotiating. In order to avoid such violations of the kinematic envelope under any circumstances, typically, the outer contour of the wagon body and the suspension system of a rail vehicle are specifically adapted to the track system the vehicle is to be operated on.

Although, by this means, in a passive suspension system a violation of the kinematic envelope of the respective track may be effectively avoided, this approach has the disadvantage that it typically results, on the one hand, in a rather restricted outer contour of the wagon body which reduces the transport capacity of the vehicle and, on the other hand, in a rather rigid suspension of the wagon body which is undesirable in terms of passenger comfort.

A further problem exists for active suspension systems comprising, for example, and active tilt control of the wagon body with respect to the running gear (i.e. a control of the tilting angle or the rolling angle, respectively, of the wagon body about a tilting axis or rolling axis, respectively, extending along the longitudinal direction of the wagon body). In such systems, for example, a malfunction of the tilting control system may lead to the introduction of excessive excursions on the wagon body with respect to the running gear leading to violations of the kinematic envelope. The same applies to an active sway motion control of the wagon body.

A further problem that may arise with such active suspension systems is that, for example, a malfunction of the tilting control system may lead to the introduction of opposite lateral excursions of the wagon body with respect to the leading running gear and the trailing running gear. Such a situation, due to the specific kinematics of such a tilting system, would lead to a torsional loading of the wagon body leading to undesired unloading of some of the wheels of the running gears and, consequently, to a considerable increase in the risk of derailment.

It is thus an object of the present invention to provide a rail vehicle as outlined above that, at least to some extent, overcomes the above disadvantages. It is a further object of the present invention to provide a rail vehicle that provides both, high transport capacity as well as high passenger comfort while ensuring safe and reliable operation under any circumstances. Finally, it is an object of the present invention to provide a method for detecting malfunction in a suspension system allowing realization of such a vehicle.

SUMMARY OF THE INVENTION

The present invention is based on the technical teaching that safe and reliable operation of a rail vehicle providing high transport capacity as well as high passenger comfort while at the same time reducing the risk of inadvertent violations of the kinematic envelope of a given track to be negotiated or reducing the risk of derailment may be achieved by implementing a monitoring system monitoring the spatial relationship between a predefined first reference part associated to the running gear and a predefined second reference part associated to the wagon body. Monitoring of this spatial relationship allows performing a malfunction analysis identifying presence of a malfunction situation where a predefined risk level for a violation of the kinematic envelope or a predefined risk level for a derailment risk is exceeded. In such a malfunction situation a malfunction signal may be issued which, in turn, may be used to initiate predefined countermeasures to significantly reduce this risk level below a given value.

It will be appreciated that, in the sense of the present invention, the spatial relationship between the running gear and the wagon body may be defined in one or more of the six degrees of freedom (DOF) available in space. Furthermore, relative motion between the running gear and the wagon body in one or more of these degrees of freedom may be considered in the malfunction analysis. More precisely, any change in position (i.e. motion in any of the three translational degrees of freedom) as well as any change in orientation (i.e. motion in any of the three rotational degrees of freedom) may be considered (alone or in an arbitrary combination) in the malfunction analysis.

Survey of the system for such a malfunction situation allows realizing active suspension systems with an active control of the spatial relation between the running gear and the wagon body. Such an active control, on the one hand, allows maximizing the outer contour and, consequently, transport capacity of the wagon body since the spatial relationship of the wagon body with respect to the running gear (and, consequently, with respect to the kinematic envelope) may be actively adapted to a given kinematic envelope. Furthermore, such an active suspension system may be optimized in terms of the passenger comfort since its rigidity and damping characteristics may be actively adapted to the current running situation of the vehicle. Thanks to the malfunction survey according to the invention, both advantages are achieved without increasing the risk of a violation of the kinematic envelope or the derailment risk.

By this means, an active vehicle suspension system may be achieved that fulfils sophisticated safety requirements. The components co-operating in the malfunction analysis may be provided in a redundant manner and/or may be provided with reliable function testing facilities (e.g. testing circuitry that regularly tests proper operation of the respective component) in order to enhance the safety level of the system. In particular, with the invention, a vehicle suspension system may be achieved that fulfils safety requirements as specified in standards such as IEC 61508, IEC 61508, EN 50126 to EN 50129.

More precisely, a safety integrity level (SIL as defined in some of these standards) up to a level 2 (SIL2) and more may be achieved.

Thus, according to a first aspect, the invention relates to a rail vehicle, comprising a wagon body and a suspension system, said suspension system comprising a running gear supporting said wagon body. A sensor device and a control device are provided. The sensor device captures an actual value of at least one status variable, said status variable being representative of a spatial relationship between a first reference part of the sensor device associated to a part of the running gear and a second reference part of the sensor device associated to the wagon body. The control device performs a malfunction analysis using said actual value of said status variable, said malfunction analysis assessing fulfillment of at least one predetermined malfunction criterion. Finally, the control device provides a malfunction signal if said malfunction analysis reveals that the malfunction criterion is fulfilled.

It will be appreciated in this context that either one of these first and second reference parts does not necessarily have to be rigidly connected to a part of the running gear and the wagon body, respectively. Rather, it may suffice that a sufficiently precisely known spatial relation exists between the respective reference part and the component it is associated to in order to assess the actual spatial relationship of interest.

Furthermore, it will be appreciated that, in the simplest case of such a malfunction analysis, the actual value of the status variable captured by the sensor device may be used as a simple comparison value which is then compared to a simple threshold value in order to assess if a malfunction situation exists (e.g. in case the threshold value is exceeded by the actual captured value of the status variable). However, in other preferred variants, the malfunction analysis may be based on a plurality of captured values which are then analysed according to one or more given malfunction criteria. For example, in the malfunction analysis, it may be assessed for a given plurality of N values of the status variable captured in a given time interval if a given malfunction threshold has been exceeded more than M times (malfunction criterion). If this is the case, the control device may determine that a malfunction situation exists and may issue the malfunction signal.

It will be further appreciated that, of course, one or more further arbitrarily sophisticated malfunction criteria may be used (in addition or as an alternative) in the malfunction analysis. In particular, at least one further status variable (i.e. an additional, different status variable) captured by the sensor device may be considered in the malfunction analysis.

The status variable may be any suitable variable that is representative of the spatial relation (position and/or orientation) between the first reference part and the second reference part (and, consequently, between the running gear and the wagon body) in one or more of the available six degrees of freedom. The respective selected degree(s) of freedom depend(s) on the direction of the respective motion(s) to be considered that could lead to a violation of the kinematic envelope or to an inadmissible increase in the derailment risk.

Preferably, the rail vehicle defines a longitudinal direction, a transverse direction and a height direction and the status variable is representative of a transverse displacement between the first reference part and the second reference part in the transverse direction. By this means, transverse motion (also called lateral motion or sway motion) of the wagon body with respect to the running gear may be considered in the malfunction analysis. This is of particular advantage since, especially when negotiating comparatively narrow curves (comparatively small radius of curvature) with a vehicle having a comparatively long wagon body, this transverse motion typically is the main limiting factor to respect the kinematic envelope. Furthermore excess opposite transverse motion with respect to a leading running gear and a trailing running gear may be the crucial factor in assessing the derailment risk.

In addition or as an alternative, the status variable may be representative of an angular yaw displacement between the first reference part and the second reference part about the height direction. Again, especially when negotiating comparatively narrow curves with a vehicle having a comparatively long wagon body, this yaw motion also provides an indication of the transverse motion of the wagon body.

Depending on the type of vehicle, in particular depending on the length of the wagon body (i.e. its dimension along the longitudinal direction of the vehicle), the characteristics of the sensor device and/or the control device may be defined in a static manner. For example, especially with relatively short wagon bodies, a simple sensor device with a static sensitivity characteristic in the transverse direction may be sufficient to detect an excess lateral or transverse movement between the running gear and the wagon body under any operating condition of the rail vehicle (i.e. irrespective of the running speed, the curvature of the track, the superelevation of the track etc).

However, in particular with longer wagon bodies (showing a considerable transverse displacement with respect to the track center at locations remote from the running gear) it is preferred that the sensor device and/or the control device provides an adaptation of the malfunction analysis to an actual running condition of the rail vehicle. In this case, the actual running condition may, for example, be defined by a running speed of the vehicle and/or a running direction of the vehicle and/or a track geometry of a track currently negotiated by the vehicle. The track geometry may be defined by any suitable track parameter. Preferably, the track geometry is defined by at least one of a curvature of the track, a superelevation of the track and a torsion value of the track. By this means it is easily possible to properly define (operation condition dependent) allowable limits of the relative motion between the running gear and the wagon body and to consider these limits in the malfunction analysis.

For example, for a comparatively long wagon body, the admissible value of a transverse excursion of the wagon body with respect to the running gear detected in the region of the running gear may be considerably smaller on a curved, superelevated track than on a straight, level track. This is due to the fact that, at a location remote from the running gear, a considerable transverse excursion of the wagon body (with respect to the track center) merely results from the track geometry such that, in order to respect a given kinematic envelope, only a considerably smaller additional transverse deflection may be admissible in the area of the running gear (where the detection of this excursion takes place).

With preferred embodiments of the invention, an active adaptation of the malfunction analysis to the actual running or operating condition of the vehicle takes place. To this end, preferably, the sensor device comprises a running condition sensor unit capturing an actual value of a running condition variable, the running condition variable being representative of the actual running condition of the rail vehicle. The control device executes the malfunction analysis as a function of the actual value of the running condition variable provided by the running condition sensor unit.

To this end, any suitable variable representative of the actual running condition of the rail vehicle may be used. For example, the adaptation of the malfunction analysis takes place as a function of at least one variable representative of the actual curvature of the track currently negotiated (as the running condition variable). As outlined above, the control device may adjust the admissible limit for a transverse deflection (applied in the malfunction analysis) as a function of the curvature currently detected (as the running condition variable).

In addition or as an alternative, the sensor device may modify its capturing behavior of the status variable as a function of the actual value of the running condition variable. This may be done in an active way as well, i.e. as a function of the actual value of a running condition variable captured by and/or provided to the sensor device.

However, with other embodiments of the invention (preferred due to their very simple and robust design), a purely passive solution may be implemented. In such a purely passive variant, the capturing behavior of the sensor device (e.g. its sensitivity characteristic) automatically (passively) changes as a function of the respective running condition of the rail vehicle.

Such a passive adaptation may be simply achieved by an appropriate arrangement of the components of the sensor device. For example, the first and second reference part may be arranged such that their relative position changes in the transverse direction with a yaw movement (i.e. a rotation about a yaw axis parallel to the height direction and defined by the suspension system at) of the wagon body with respect to the running gear as it occurs as a function of the curvature of the track currently negotiated. The distance of the first and second parts of the sensor device with respect to the yaw axis may be selected such that the yaw movement related transverse displacement leads to a reduction of any further transverse displacement that is admissible until the malfunction analysis detects a malfunction situation.

Furthermore, with other embodiments of the invention, the geometry and/or on the sensitivity characteristic of the first and/or second reference part may be adapted to provide the desired passive adaptation of the capturing behavior of the sensor device. For example, a sensor element (forming one of the first and second reference part of the sensor device) may co-operate with a reference element (forming the other one of the first and second reference part) to provide a detection signal. The sensor element may have a direction dependent sensitivity, i.e. a sensitivity depending on the respective detection direction (e.g. in such a manner that the detection signal is provided at given, eventually different, distances between the sensor element and the second reference element in the respective detection direction). The direction dependent sensitivity of the sensor element may then be adapted to the specific application in such a manner that, upon a certain change in the relative position between the first and second reference part (i.e. a change in the relative position between the running gear and the wagon body) due to the current operation situation, said detection signal is provided at different transverse displacements between the running gear and the wagon body.

Finally, for a sensor with a direction independent sensitivity (over its usable field of view) such a result may also be obtained by adapting the geometry the reference element in order to provide the desired adaptation of the malfunction analysis to the respective operation situation or running condition of the vehicle, respectively. Obviously, arbitrary combinations of the above variants of adaptation of the malfunction analysis may be used.

Thus, with preferred variants of the rail vehicle according to the invention, the sensor device comprises a status variable sensor unit capturing the actual value of the status variable in a sensing direction. The status variable sensor unit has a capturing behavior in the sensing direction, in particular, a sensitivity in the sensing direction, that varies as a function of the actual running condition of the rail vehicle. The status variable sensor unit may have any capturing characteristic suitable for the respective adaptation. Preferably, the status variable sensor unit, at least section wise, has a linear and/or spherical capturing characteristic.

In very simple and robust embodiments, the status variable sensor unit comprises a sensing element and an associated reference element, the sensing element capturing a value representative of at least one distance between the sensing element and the reference element as the actual value of the status variable in the sensing direction. The sensing element forms the first reference part or the second reference part and the reference element forms the other one of the first reference part and the second reference part. As outlined above, the sensing element and the reference element may be arranged such that, at least in the sensing direction, a relative position between the sensing element and the reference element vanes as a function of the actual running condition of the rail vehicle to provide the variation in the capturing behavior in the sensing direction. In very simple designs, the sensing element and the reference element may be arranged at a distance, in particular at a distance along the longitudinal direction, from a yaw axis defined by the suspension system between the running gear and the wagon body.

In principle, any sensor providing a signal representative of the spatial relation between the first and second reference part may be used for the sensor device. Preferably, the sensor device comprises a least one distance sensor capturing a least one value representative of a distance between the first reference part and the second reference part.

It will be appreciated that the sensor device does not necessarily have to provide a continuous measurement of the spatial relation between the first and second reference part in one or more directions. Rather, for the malfunction analysis to be performed, it may be sufficient that the sensor unit only provides a corresponding detection signal when a predetermined spatial relation between the first and second reference part is reached. For example, a simple binary signal may be sufficient indicating that a certain distance between the first and second reference part has been exceeded (e.g. signal level: 1) or not (e.g. signal level: 0). Thus, preferably, the at least one distance sensor may be designed in the manner of an proximity switch which typically provides such a simple binary signal.

The sensor device, in principle, may be arranged at any suitable location within the rail vehicle in order to provide the actual value of the desired status variable. Preferably, the wagon body is supported on the running gear via a secondary spring system of the suspension system and the first reference part and the second reference part are arranged kinematically parallel to at least a part of the secondary spring system.

As mentioned above, the second reference part does not necessarily have to be rigidly connected to the wagon body. Thus, with preferred embodiments of the invention, the first reference part is connected to a first part of the running gear while the second reference part is connected to a second part of the running gear, in particular to a bolster supported via a part of the secondary spring system on the first part of the running gear. With other embodiments, however, the second reference part may also be connected to the wagon body.

Furthermore, any suitable location may be chosen for the first and second reference part. With certain, rather compact embodiments of the invention, the first reference part and/or the second reference part are integrated into a component of the secondary spring system, in particular an airspring of the secondary spring system. Comparably compact arrangements may also be achieved if the first reference part and/or the second reference part are integrated into an actuator device generating adjustment forces and/or adjustment movements between the running gear and the wagon body.

The malfunction signal may be used in an arbitrary way within the vehicle. For example, in the simplest case, the malfunction signal is used to trigger an audio and/or video signal by which the driver of the vehicle and/or a remote control center is notified of the malfunction situation. The driver and/or the remote control center may then initiate appropriate countermeasures against the potentially hazardous malfunction situation.

However, preferably, the malfunction signal is used to automatically initiate appropriate countermeasures. For example, of the malfunction signal itself may be used to control components of the active suspension system. Thus, with advantageous embodiments of the invention, the suspension system comprises a force exerting device, the force exerting device, under control of the control device, exerting a force within the suspension system that influences the at least one status variable.

The force exerting device preferably modifies its operation as a function of the malfunction signal in order to counteract the inappropriate operation in such a malfunction situation. This may be done in various ways. For example, it may be provided that the force exerting device, upon receipt of the malfunction signal, switches into a mode wherein it counteracts any motion which could potentially aggravate the malfunction situation.

With embodiments, where the force exerting device itself is a potential source of the malfunction, preferably, the force exerting device switches into a deactivated mode of operation in response to the malfunction signal.

Furthermore, the force exerting device may be adapted to exert, in the deactivated mode of operation, a resetting force within the suspension system, the resetting force acting to reset the wagon body into a predetermined neutral position with respect to the running gear. By this means, a reliable reduction of the risk associated with the malfunction may be achieved.

The force exerting device may be of any suitable design as well as located at arbitrary suitable locations within the suspension system. Preferably, the force exerting device comprises an actuator device, in particular a tilt actuator adjusting a tilt angle of the wagon body about a tilt axis running in a longitudinal direction of the vehicle. In addition or as an alternative, the force exerting device comprises a damper device, in particular a yaw damper device, damping movements between the running gear and the wagon. As mentioned above, in addition or as an alternative, the first reference part and/or the second reference part may be integrated into a component of the force exerting device, in particular in an actuator device of the force exerting device, leading to an advantageously compact design.

It will be appreciated in this context that the first and second reference part may be any suitable part of the force exerting device executing a defined relative motion when exerting the force within the suspension system influencing the at least one status variable. Furthermore, it will be appreciated that, in this case, relative motion does not necessarily have to be directly measured between the first and second reference part. Rather, as outlined above, it may be provided that the sensor device captures an actual value of at least one status variable representative of a spatial relationship between the first and second reference part.

For example, if the force exerting device is a hydraulic actuator with a piston and a cylinder (together defining a working chamber of the actuator), the sensor device may simply capture the degree of filling of the working chamber (by suitable means) which is also representative of the relative position between the piston (e.g. forming the first reference element) and the cylinder (e.g. forming the second reference element).

The present invention further relates to a method for detecting malfunction in a suspension system of a rail vehicle with a wagon body and a suspension system comprising a running gear supporting the wagon body, wherein an actual value of at least one status variable is captured, the status variable being representative of a spatial relationship between a first reference part associated to the running gear and a second reference part associated to the wagon body. Furthermore, a malfunction analysis is performed using said actual value of said status variable, said malfunction analysis assessing fulfillment of at least one predetermined malfunction criterion. A malfunction signal is provided if the malfunction analysis reveals that the malfunction criterion is fulfilled. With this method the advantages and embodiments as outlined above in the context of the rail vehicle may be achieved to the same extent such that it is here only referred to the explanations given above.

BRIEF DESCRIPTION OF THE DRAWINGS

Further embodiments of the present invention will become apparent from the following description of preferred embodiments which refers to the appended figures.

DESCRIPTION OF THE PREFERRED EMBODIMENTS

First Embodiment

Figure 1:
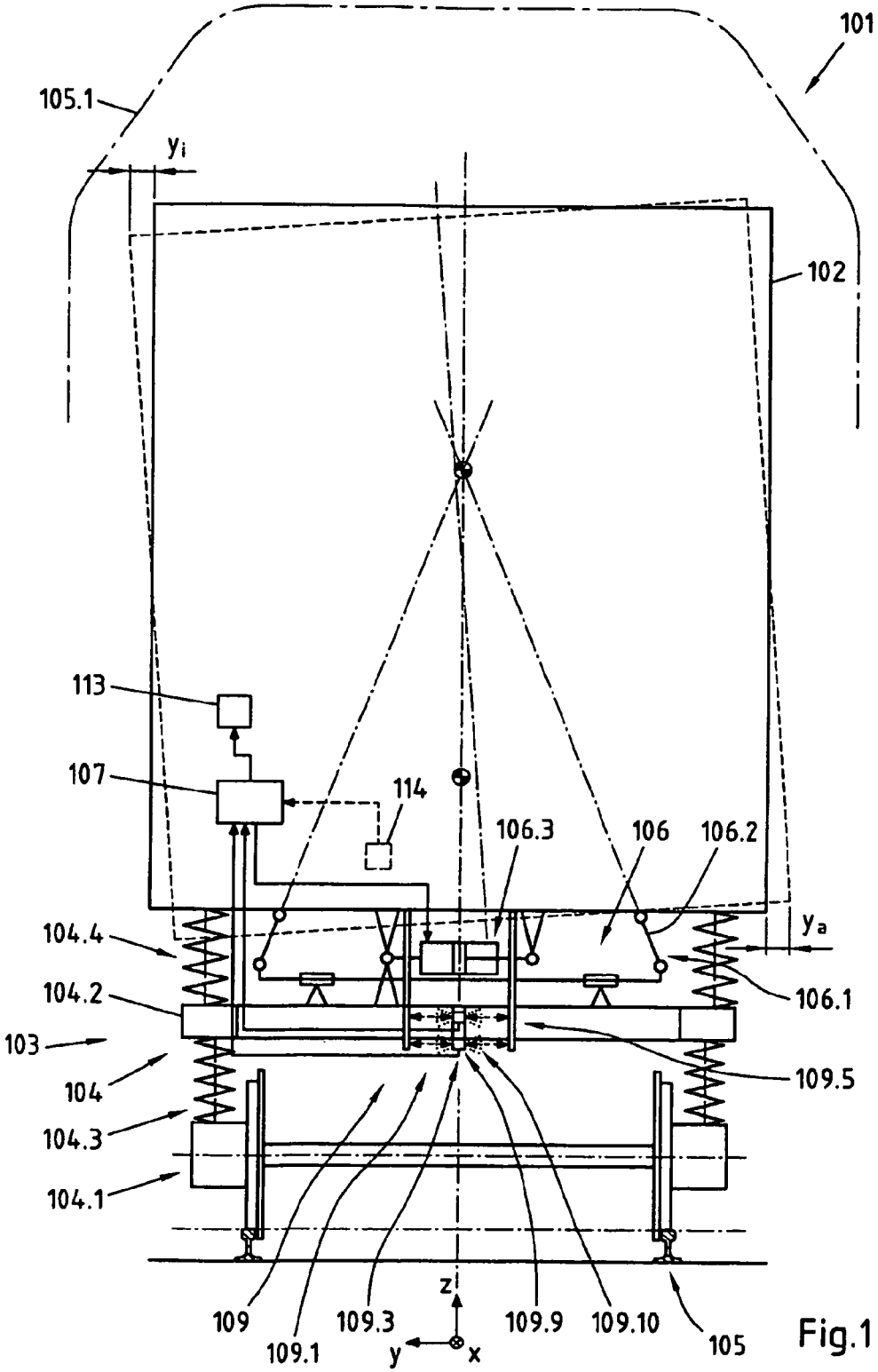
FIG. 1 is a schematic sectional representation of a preferred embodiment of a vehicle according to the present invention (seen along line I-I of FIG. 3) with which a preferred embodiment of the method according to the invention may be executed.

With reference to FIGS. 1 to 4 a preferred embodiment of a rail vehicle 101 according to the present invention will now be described in greater detail. In order to simplify the explanations given below, and xyz-coordinate system has been introduced into the Figures, wherein (on a straight, level track) the x-axis designates the longitudinal direction of the vehicle 101, the y-axis designates the transverse direction of the vehicle 101 and the z-axis designates the height direction of the vehicle 101.

The vehicle 101 comprises a wagon body 102 supported by a suspension system 103. The suspension system 103 comprises two running gears 104 sitting on a track 105 and supporting the wagon body 102. Each running gear 104 comprises two wheel sets 104.1 supporting a running gear frame 104.2 via a primary spring unit 104.3. The running gear frame 104.2 supports the wagon body 102 via a secondary spring unit 104.4.

The suspension system 103 comprises an active tilting unit 106 arranged kinematically parallel to the secondary spring unit 104.4. The tilting unit 106 forms an active part of the suspension system 103 and serves to adjust a tilting or rolling angle $\alpha_w$ about a tilting or rolling axis arranged in parallel to the longitudinal direction (x-axis) of the vehicle 101. To this end, the tilting unit 106 comprises a well-known rolling support 106.1 hinged to the running gear frame 104.2 and to the wagon body 102. The rolling support 106.1 comprises inwardly inclined links 106.2 providing, in a well-known manner, a tilting effect upon a lateral excursion of the wagon body 102, i.e. a relative excursion of the wagon body 102 with respect to the running gear 104 in the transverse direction (y-axis).

The tilting unit 106 further comprises an active force exerting device in the form of a tilting actuator 106.3 connected to, both, the running gear frame 104.2 and the wagon body 102. The tilting actuator 106, under the control of a control device in the form of a control unit 107, serves to actively adjust the tilting angle $\alpha$ as a function of the current running condition of the vehicle 101. Typically, the tilting control algorithms implemented in the control unit 107 adapted to avoid (under proper operation) any violation of the kinematic envelope 105.1 specified for the respective track 105 the vehicle 101 is to be operated on.

Obviously, it is absolutely mandatory that the kinematic envelope 105.1 is respected under any operating condition of any vehicle operated on the track 105, in particular, also under a failure condition of any active components of a tilting system of the vehicle. With conventional vehicles, this requirement is fulfilled by limiting, both, the outer contour of the wagon body and the transverse movement of the wagon body (e.g. by mechanical stops or the like). However, on the one hand, the restriction to the outer contour of the wagon body has adverse effect of reducing its transport capacity. On the other hand, limiting lateral excursions by mechanical stops also has its drawbacks since these stops have to be designed to fit the worst-case scenario, i.e. the operating condition of the vehicle in a given kinematic envelope with the severest limitations to the lateral excursions. Thus, eventually, under operating conditions different from this worst-case scenario (i.e. in situations with less severe limitations to the lateral excursions) a desirable range of lateral excursions, despite being admissible in a given kinematic envelope, may not be obtained.

To avoid these problems the vehicle 101 according to the invention comprises a sensor device 109 which is connected to the control unit 107. The sensor device 109 comprises two sensor arrangements 109.1 and 109.2, each comprising a sensor unit 109.3 and 109.4 and associated reference elements 109.5 to 109.8, respectively. The sensor units 109.3 and 109.4 are mechanically connected to the running gear frame 104.2 while the (plate shaped) reference elements 109.5 to 109.8 mechanically connected to the wagon body 102 such that, in the neutral state shown in FIGS. 1 and 2 a certain transverse distance (in the y-direction) lies between the sensor unit 109.3 and 109.4 and the surface of the respective associated reference element 109.5 to 109.8.

In the sense of the present invention, the sensor units 109.3 and 109.4 form first reference parts of the sensor device 109 while the reference elements 109.5 to 109.8 form second reference parts of the sensor device 109. Each sensor unit 109.3 and 109.4 comprises two sensor elements 109.9 associated to each of the reference elements 109.5 to 109.8.

Thus, in the embodiment shown, eight sensor elements 109.9 are provided. However, with other embodiments of the invention, any other suitable number of sensor elements may be selected, in particular, depending on the selected redundancy level and the required sensors for the malfunction algorithm. Preferably, the number of sensors will be at least two up to eight.

Each sensor element 109.9 has a predetermined capturing characteristic or a sensitivity characteristic, respectively, defined by a confined field of sight 109.10 which is mainly directed in the transverse direction (y-axis). In the embodiment shown, each sensor unit 109.3 and 109.4 is a simple distance sensor designed in the manner of a proximity switch. More precisely, each sensor element 109.9 provides a binary signal, the signal level being "0" as long as the associated reference element 109.5 to 109.8, respectively, does not interfere with the field of sight 109.10, and the signal level switching to "1" as soon as the associated reference element 109.5 to 109.8, respectively, interferes with the field of sight 109.10.

Thus, in the sense of the present invention, the signal provided by each sensor element 109.9 represents an actual value of a status variable which is representative of the spatial relation between the respective first reference parts (sensor units 109.3 and 109.4, respectively) and the associated second reference parts (reference elements 109.5 to 109.8, respectively), namely their mutual distance in the transverse direction (y-axis). Since the first and second reference parts are connected to the running gear 104 and the wagon body 102, respectively, these actual values (of the status variable) are also representative of the spatial relation between the running gear 104 and the wagon body 102 in the transverse direction (y-axis).

The control unit 107 is adapted to control the operation of the actuator unit 106.3 in such a manner that, under any operating or running condition of the vehicle 101, the kinematic envelope 105.1 and a given derailment risk level is respected. To this end, the control unit receives the signals from the sensor elements 109.9 and performs a malfunction analysis using these signals.

In the simplest case of such a malfunction analysis, the actual value of the signals provided by the respective sensor device 109 is used as a simple comparison value which is then compared to a simple threshold value in order to assess if a malfunction situation exists. With the simple binary signals provided by the respective sensor device 109, the control unit 107 simply performs a check if one of the signals of the sensor elements 109.9 is at level "1" (i.e. the control unit 107 performs a check if the threshold value "1" is reached by one of the actual captured values of the status variable). If this is the case, i.e. if the malfunction criterion is fulfilled, the control unit 107 issues a malfunction signal.

However, in other variants, the malfunction analysis may be assessed for a given plurality of N discrete values of the signals of the sensor element 109.9 in a given time interval T if a given malfunction threshold has been exceeded more than M times (malfunction criterion). If this is the case, the control unit 107 may determine that a malfunction situation exists and may issue the malfunction signal.

In the embodiment shown, the control unit 107, on the one hand uses this malfunction signal as a signal to issue a notification to the driver of the vehicle 101 of the malfunction situation via a signaling device 113.

Furthermore, in the embodiment shown, the control unit 107 uses this malfunction signal as a signal to switch off or deactivate the actuator 106.3. Depending on the rigidity of the suspension system, in particular the rigidity of the secondary spring device 104.4, this may be sufficient to avoid violation of the kinematic envelope 105.1 under any circumstances. However, if this is not the case, it may be provided that the actuator 106.3 itself or any other component acting between the running gear 104 and the wagon body 102, in this deactivated state of the actuator 106.3, exerts a resetting force on the wagon body 102 which acts to return the wagon body 102 to its neutral position ($\alpha_w$=0) as it is shown in FIG. 1.

Figure 2:
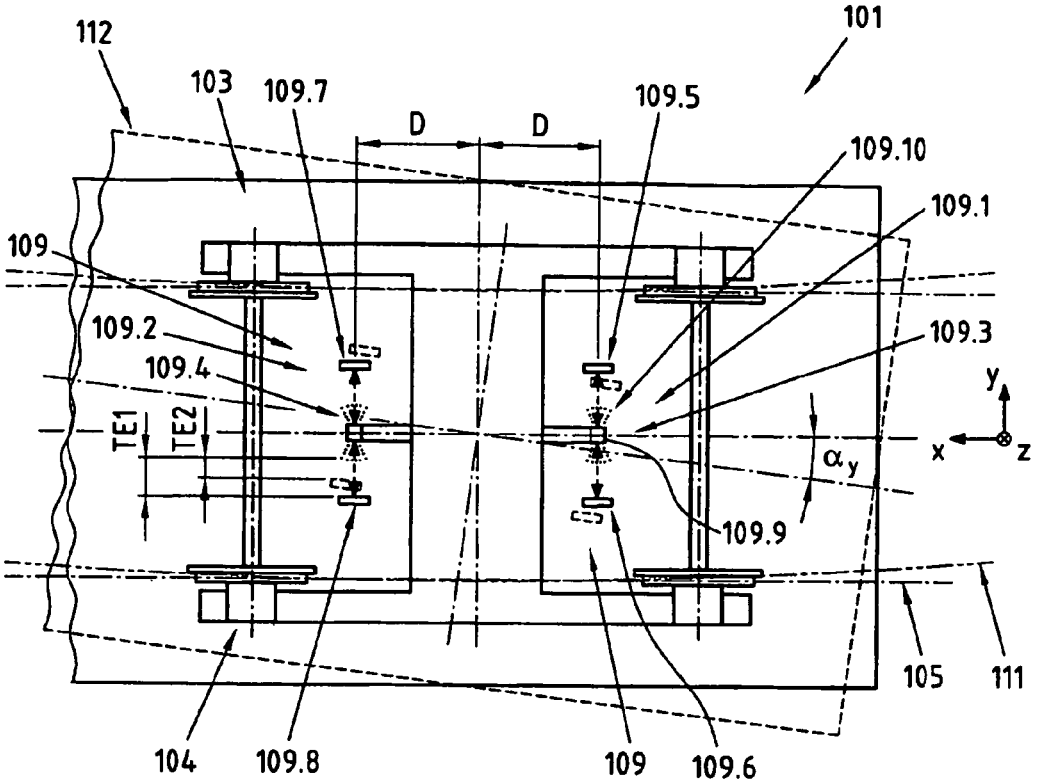
FIG. 2 is a schematic representation of a detail of the vehicle of FIG. 1 seen from below (i.e. from track level as indicated by line II-II in FIG. 3)
Figure 3:
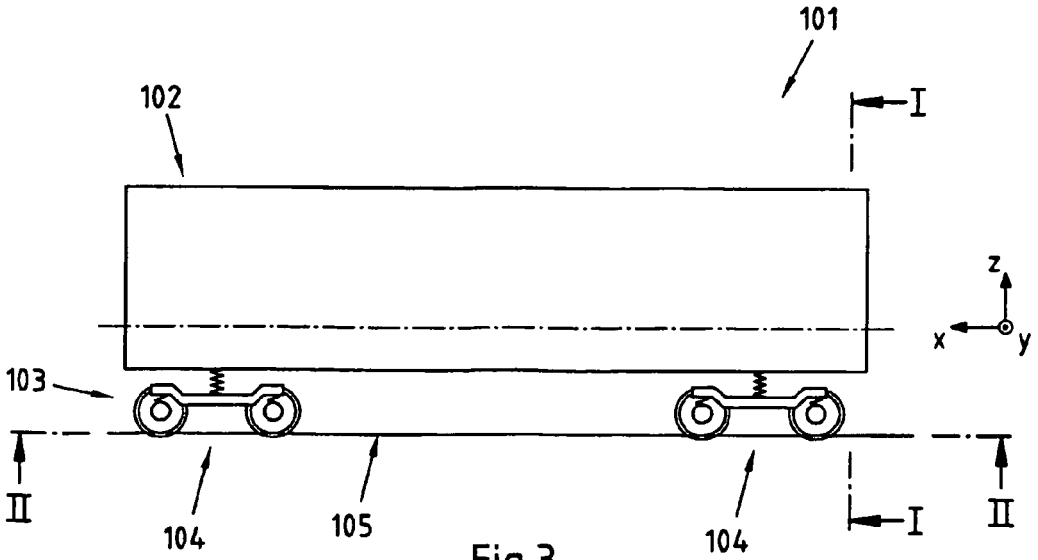
FIG. 3 is a schematic side view of the vehicle of FIG. 1.

As can be seen from FIG. 2 (in the neutral state of the vehicle 101 standing on a straight level track) the sensor units 109.3 and 109.4 are located at a distance D (in the longitudinal direction) from the yaw axis (arranged parallel to the height axis or z-axis, respectively) defined between the running gear 104 and the wagon body 102. This has the effect that, when negotiating a curved track (as it is indicated in FIG. 2 by the double-dot-dashed contour 111), the wagon body 102 with the reference elements 109.5 to 109.8 exerts a yaw movement (i.e. rotates about the yaw axis by a yaw angle $\alpha_y$) leading to a noticeably modified distance in the transverse direction (y-axis) between the sensor units 109.3, 109.4 and the reference elements 109.5 to 109.8 as it is indicated by the dashed contour 112 in FIG. 2.

Thus, while there is an (admissible) lateral excursion TE1 between the wagon body 102 and the running gear 104 until the control unit 107 issues the malfunction signal (e.g. due to the interference of the reference element 109.8 with the field of view 109.10 of the associated sensor element 109.9), on a curved track 111, the (admissible) lateral excursion TE2 between the wagon body 102 and the running gear 104 until the control unit 107 issues the malfunction signal is considerably reduced. This has the beneficial effect that the malfunction analysis provided by the control unit 107 is automatically adapted to the running situation of the vehicle 101 in a simple, passive way.

This adaptive survey of the suspension system 103 for a malfunction situation allows realizing a system with an active control of the spatial relation between the running gear 104 and the wagon body 102. The active control allows maximizing the outer contour and, consequently, the transport capacity of the wagon body 102 since the spatial relationship of the wagon body 102 with respect to the running gear 104 may be actively adapted to a given kinematic envelope 105.1. Furthermore, the active suspension system 103 may be optimized in terms of the passenger comfort since its rigidity and damping characteristics may be actively adapted to the current running situation of the vehicle 101. Thanks to the malfunction survey according to the invention, both advantages are achieved without increasing the risk of a violation of the kinematic envelope 105.1.

Figure 4A:
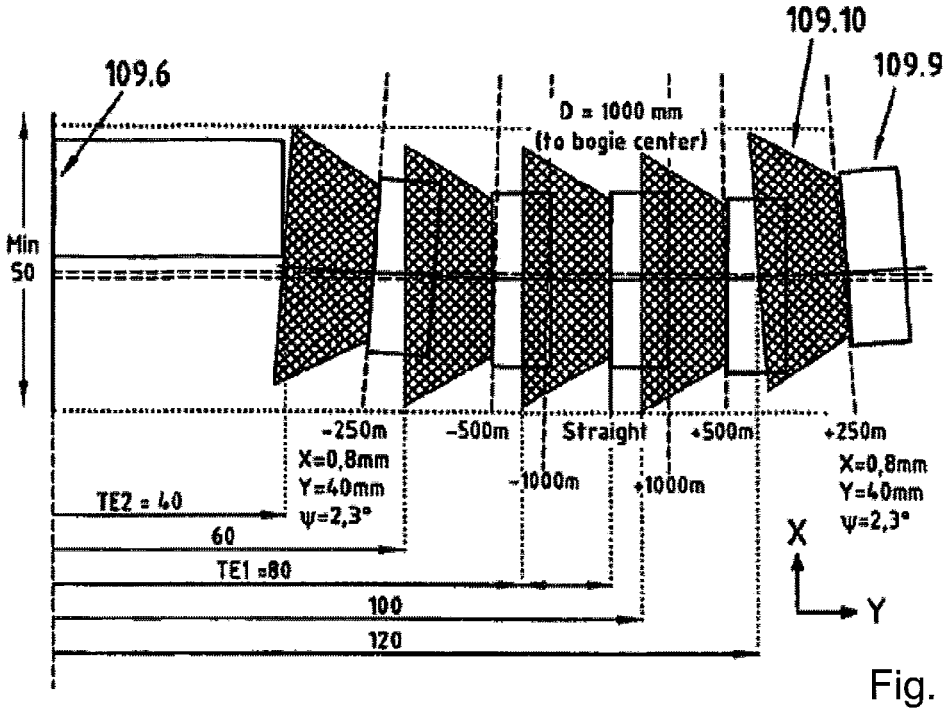
FIG. 4A is a schematic detailed view of a part of the vehicle of FIG. 1.

Exemplary dimensions for the arrangement of a sensor element 109.9 and an associated reference element 109.6 and its location in the suspension system are given in FIG. 4A for different radii of curvature of the track negotiated (unless otherwise stated, all dimensions are given in millimeters). As can be seen easily from FIG. 4A, depending on the radius of curvature of the track (−250 m, −500 m etc.)

As can be seen from FIG. 4A at a straight track the distance of the reference element 109.6 to the sensor element 109.9 is 95 mm (80 mm allowed movement and 15 mm detection zone or field of sight, respectively, of the sensor element 109.9). The sensor element has to move 40 mm towards the reference element 109.6 for curves with a radius of curvature of R=−250 m, in order to restrict the transverse wagon body movement to 40 mm (80 mm−40 mm=40 mm). It will be appreciated that, of course, with other embodiments of the invention, any dimension (other than 15 mm) may be selected for the detection zone or field of sight, respectively, of the sensor element 109.9.

To this end, the sensor element 109.9 has to be placed at a certain longitudinal distance D≈1000 mm from the yaw axis located centrally in the running gear 104 to have this displacement with the a yaw angle $\alpha_y$=2.3° (resulting for the vehicle 101 at such a radius of curvature R). Obviously, this distance D depends on the longitudinal distance between the two running gears 104, since the latter defines the yaw angle $\alpha_y$ at any curvature of the track.

For positive curves the sensor element 109.9 moves further away from the reference element 109.6 (e.g. to 100 mm for R=+500 m). For smaller curves of R=+250 m, the sensor element 109.9 moves even further away. This, however, may have no specific influence in cases where the actuator 106.3 is limited to a certain stroke in this direction (here e.g. to a maximum stroke of 100 mm in this direction). It should be noted that, in such cases, it might even be sufficient to omit detection on one side of the wagon body 102, i.e. to omit reference elements 109.5 and 109.7 and to use reference elements 109.6 and 109.8 only.

Depending on the shape of the field of sight 109.10 of the sensor element 109.1 there may be a small error due to the angle of rotation of the sensor on current tracks. To minimize this error, the sensor element 109.1 is best placed in the longitudinal center line of the running gear 104.

The reference elements 109.5 to 109.8 preferably have a surface area of at least 45 mm×45 mm for a sensor element 109.9 working with inductive detection. Preferably the surface area is larger to allow longitudinal and vertical movements between the sensor element 109.9 and the respective reference element 109.5 to 19.8. However, it will be appreciated that, with other embodiment of the invention, any other type of sensor element may be used working with a different detection principle, e.g. optical, electrical, mechanical principles alone or in arbitrary combination.

With the invention an active vehicle suspension system may be achieved that fulfils sophisticated safety requirements. As can be seen from FIG. 1 two sensor elements 109.9 provided her reference element 109.5 to 109.9 to provide a redundant arrangement.

Figure 4B:
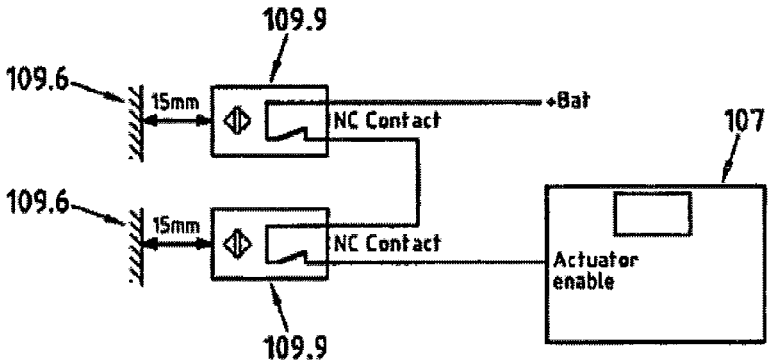
FIG. 4B is a schematic block diagram of a part of the vehicle of FIG. 1.
Figure 4C:
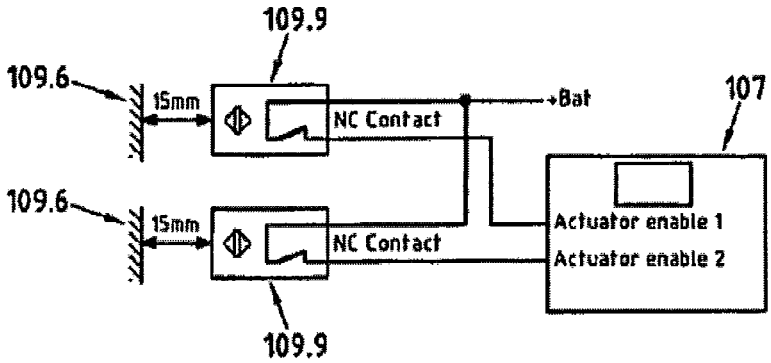
FIG. 4C is a schematic block diagram of an alternative outlay of the part of the vehicle shown in FIG. 4A.

FIGS. 4B and 4C show different exemplary wiring possibilities for these two redundantly arranged sensor elements 109.9, namely a serial arrangement (FIG. 4B) and a parallel arrangement (FIG. 4C). The parallel arrangement shown in FIG. 4C is preferred under the aspect of testing since it allows recognizing a failure of one of the sensor elements 109.9 (to prevent dormant failures). In any case, reliable function testing facilities (e.g. testing circuitry that regularly tests proper operation of the respective component) may be provided in order to enhance the safety level of the system. Thus, with the invention, a vehicle suspension system 103 may be achieved that fulfils safety requirements as specified in standards such as IEC 61508, IEC 61508, EN 50126 to EN 50129. More precisely, a safety integrity level (SIL as defined in some of these standards) up to a level 2 (SIL2) and more may be achieved.

It will be appreciated that, with other embodiments of the invention, the above (running condition dependent) adaptive malfunction analysis may also be achieved actively. To this end, the actual running condition may, for example, be defined by a running speed of the vehicle and/or a running direction of the vehicle and/or a track geometry of a track currently negotiated by the vehicle, and at least one running condition sensor (as indicated by the dashed contour 114 in FIG. 1) of the sensor device may capture one or more suitable running condition variables representative of these specific components defining the actual running condition.

In this case, the control device 107 executes the malfunction analysis as a function of the actual value of the running condition variable provided by the running condition sensor unit 114. Any suitable variable representative of the actual running condition of the rail vehicle may be used. For example, the adaptation of the malfunction analysis takes place as a function of at least one variable representative of the actual curvature of the track currently negotiated (as the running condition variable). As outlined above, the control device may adjust the admissible limit for a transverse deflection (applied in the malfunction analysis) as a function of the curvature currently detected by the running condition sensor 114. In such a case, it may be sufficient to have one single sensor element 109.9 capturing the distance to the reference element 109.6 at a sufficiently high resolution.

In addition or as an alternative, the sensor device may modify its capturing behavior (e.g. the shape and/or size of its field of sight 109.10) as a function of the actual value of the running condition variable. This may be done in an active way as well, i.e. as a function of the actual value of a running condition variable captured by and/or provided to the sensor device.

It will be further appreciated that, with other embodiments of the invention, in addition or as an alternative to the first and second reference parts 109.5 to 109.9, first and second reference parts may be integrated into the actuator unit 106.3. The first and second reference part may be any suitable part of the actuator unit 106.3 executing a defined relative motion when exerting the force within the suspension system 103. For example, the piston of actuator unit 106.3 may form the first reference part while the cylinder of actuator unit 106.3 forms the second reference part.

It will be further appreciated that, in this case, relative motion does not necessarily have to be directly measured between the first and second reference part using any desired and suitable distance sensor. Rather, as outlined above, it may be provided that the sensor device 109 captures an actual value of at least one status variable representative of a spatial relationship between the first and second reference part. For example, in the case of the hydraulic actuator 106.3, the sensor device may simply capture (by suitable means) the degree of filling of the working chamber defined by the piston and the cylinder of the actuator 106.3 which is also representative of the relative position between the piston and the cylinder.

Finally, it will be appreciated that any desired number of actuators integrating the first and second reference parts may be provided to achieve the desired redundancy and accuracy. For example, two actuators 106.3 may be provided per running gear. Preferably these two actuators 106.3 may be arranged at a location similar to the one of the reference parts 109.5 to 109.9 as outlined above.

Second Embodiment

Figure 5:
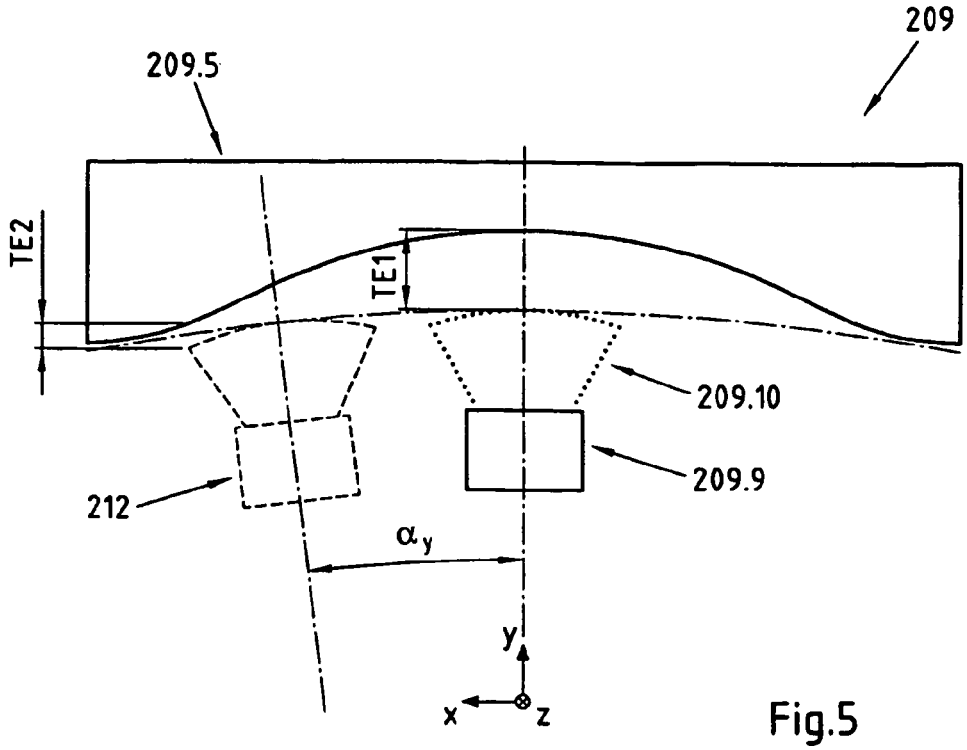
FIG. 5 is a schematic sectional view of a further preferred embodiment of the vehicle according to the present invention (in a view similar to the one of FIG. 2).

With reference to FIG. 5 a further preferred embodiment of a sensor device 209 according to the present invention will now be described in greater detail. The sensor device 209 may replace the sensor device 109 in the vehicle 101 of FIG. 1. The sensor device 209, in its basic design and functionality, largely corresponds to the sensor device 109 such that it will be mainly referred to the differences only. Moreover, identical or like components are given the same reference numerals increased by 100. Unless deviating explanations are given in the following it is here explicitly referred to the explanations given above with respect to the features and functions of these components.

The difference with respect to the sensor device 109 lies within the fact that the adaptation of the malfunction analysis to the respective running condition is provided via an adaptation of the geometry of the reference element 209.5 (connected to the wagon body 102). As can be seen from FIG. 5, the sensor element 209.9 (connected to the running gear 104) and the reference element 209.5 (connected to the wagon body 102) are arranged such that, in the neutral state of the vehicle, they are transversely but not longitudinally offset with respect to the yaw axis (between the running gear 104 and the wagon body 102).

The adaptation of the admissible transverse excursion under the respective running condition (e.g. TE1 and TE2) and, thus, adaptation of the malfunction analysis is provided by the curvature of the detection surface of the reference element 209.5. It will be appreciated that, by this simple means of modifying the surface of the reference element 209.5 virtually any desired adaptation to the actual running condition of the vehicle may be achieved. It will be appreciated that any suitable geometry may be chosen for the reference element of 209.5. In particular, arbitrary suitable combinations of straight and curved sections may be chosen as needed for the required adaptation of the malfunction analysis.

Third Embodiment

Figure 6:
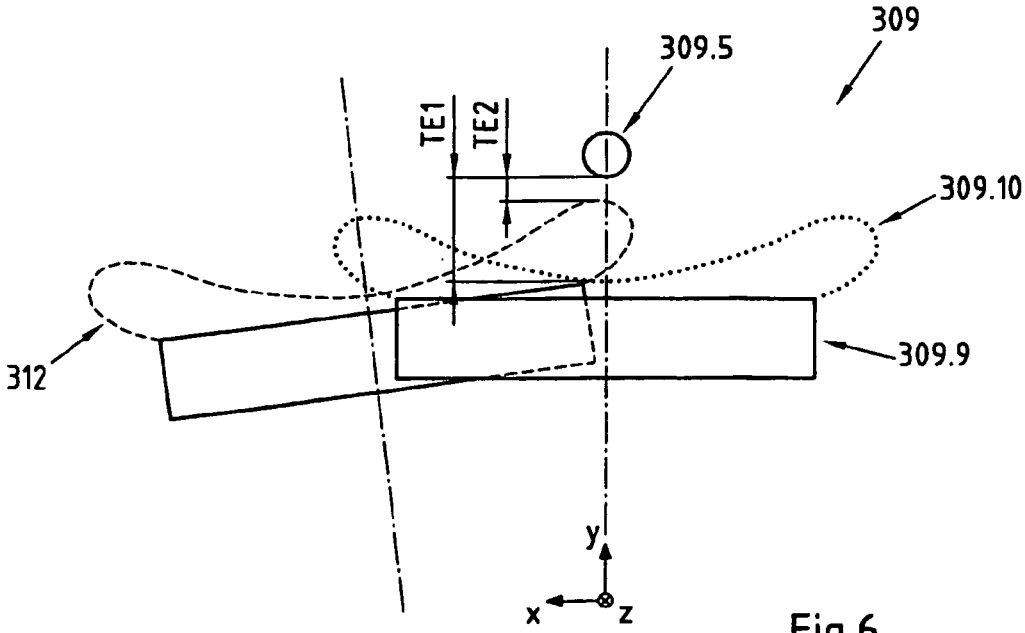
FIG. 6 is a schematic sectional view of a further preferred embodiment of the vehicle according to the present invention (in a view similar to the one of FIG. 2).

With reference to FIG. 6 a further preferred embodiment of a sensor device 309 according to the present invention will now be described in greater detail. The sensor device 309 may replace the sensor device 109 in the vehicle 101 of FIG. 1. The sensor device 309, in its basic design and functionality, largely corresponds to the sensor device 109 such that it will be mainly referred to the differences only. Moreover, identical or like components are given the same reference numerals increased by 100. Unless deviating explanations are given in the following it is here explicitly referred to the explanations given above with respect to the features and functions of these components.

The difference with respect to the sensor device 109 lies within the fact that the adaptation of the malfunction analysis to the respective running condition is provided via an adaptation of the capturing characteristics, here the geometry of the field of view 309.10 of the sensor element 309.9 (connected to the running gear 104). As can be seen from FIG. 6, the sensor element 309.9 (connected to the running gear 104) and the reference element 309.5 (connected to the wagon body 102) are arranged such that, in the neutral state of the vehicle, they are transversely but not longitudinally offset with respect to the yaw axis (between the running gear 104 and the wagon body 102).

The adaptation of the admissible transverse excursion under the respective running condition (e.g. TE1 and TE2) and, thus, adaptation of the malfunction analysis is provided by the shape, more precisely the curvature of the field of view 309.10 of the sensor element 309.9. It will be appreciated that, by this relatively simple means of modifying shape of the field of view 309.10 (i.e. the sensitivity characteristic) of the sensor element 309.9, virtually any desired adaptation to the actual running condition of the vehicle may be achieved. It will be appreciated that any suitable geometry may be chosen for the field of view 309.10 as well as for the reference element of 309.5. In particular, arbitrary suitable combinations of straight and curved sections may be chosen as needed for the required adaptation of the malfunction analysis.

In the foregoing, the present invention has been described in the context of embodiments were observation of a given kinematic envelope and a given derailment risk has been achieved. It will be appreciated, however, that, with other embodiments of the invention, observation of other criteria or limitations may be an additional or an alternative goal to be achieved. For example, in a similar manner, observation of limitations of a vehicle levelling system (adjusting the level of the wagon body above track level) may be achieved.

Although the present invention in the foregoing has only a described in the context of rail vehicles, it will be appreciated that it may also be applied to any other type of vehicle in order to overcome similar problems with respect to a space saving solution for an emergency suspension.

The invention claimed is:

1. A rail vehicle, comprising:

a wagon body and a suspension system comprising a running gear supporting said wagon body wherein a sensor device and a control device are provided;

said sensor device capturing an actual value of at least one status variable, said status variable being representative of a spatial relationship between a first reference part of said sensor device associated to a part of said running gear and a second reference part of said sensor device associated to said wagon body;

said control device performing a malfunction analysis using said actual value of said status variable and at least one predetermined malfunction criterion, said malfunction analysis assessing fulfillment of the at least one predetermined malfunction criterion and considering pre-definable allowable limits of a relative motion between said running gear and said wagon body; and said control device providing a malfunction signal if said malfunction analysis reveals that said malfunction criterion is fulfilled.

2. The rail vehicle according to claim 1, wherein:

said rail vehicle defines a longitudinal direction, a transverse direction and a height direction, and said status variable being representative of:

(1) a transverse displacement between said first reference part and said second reference part in said transverse direction, (2) an angular yaw displacement between said first reference part and said second reference part about said height direction, or both (1) and (2).

3. The rail vehicle according to claim 1, wherein:

said sensor device and/or said control device provides an adaptation of said malfunction analysis to an actual running condition of said rail vehicle;

said actual running condition is defined by a running speed of said vehicle and/or a running direction of said vehicle and/or a track geometry of a track currently negotiated by said vehicle; and said track geometry is defined by at least one of a curvature of said track, a superelevation of said track and a torsion of said track.

4. The rail vehicle according to claim 3, wherein:

said sensor device comprises a running condition sensor unit capturing an actual value of a running condition variable;

said running condition variable is representative of said actual running condition of said rail vehicle; and (1) said control device executing said malfunction analysis as a function of said actual value of said running condition variable provided by said running condition sensor unit, or (2) said sensor device modifying its capturing behavior of said status variable as a function of said actual value of said running condition variable, or both (1) and (2).

5. The rail vehicle according to claim 3, wherein:

said sensor device comprises a status variable sensor unit capturing said actual value of said status variable in a sensing direction;

said status variable sensor unit having a capturing behavior or sensitivity in said sensing direction that varies as a function of said actual running condition of said rail vehicle; and said status variable sensor unit at least section wise having linear and/or spherical capturing characteristics.

6. The rail vehicle according to claim 5, wherein:

said status variable sensor unit comprises a sensing element and an associated reference element;

said sensing element capturing a value representative of at least one distance between said sensing element and said reference element as said actual value of said status variable in said sensing direction;

said sensing element forming said first reference part or said second reference part and said reference element forming the other one of said first reference part and said second reference part;

said sensing element and said reference element being arranged such that, at least in said sensing direction, a relative position between said sensing element and said reference element varies as a function of said actual running condition of said rail vehicle to provide said variation in said capturing behavior in said sensing direction; and said sensing element and said reference element being arranged at a distance from a yaw axis defined by said suspension system between said running gear and said wagon body.

7. The rail vehicle according to claim 1, wherein:

said sensor device comprises a least one distance sensor;

said at least one distance sensor capturing a least one value representative of a distance between said first reference part and said second reference part; and said at least one distance sensor is designed in the manner of a proximity switch.

8. The rail vehicle according to claim 1, wherein:

said wagon body is supported on said running gear via a secondary spring system of said suspension system; and said first reference part and said second reference part are arranged kinematically parallel to at least a part of said secondary spring system, wherein said first reference part is connected to a first part of said running gear and said second reference part is connected to: (1) a second part of said running gear comprising a bolster supported via a part of said secondary spring system on said first part of said running gear, or (2) said wagon body; and said first reference part and/or said second reference part is integrated into a component of said secondary spring system.

9. The rail vehicle according to claim 1, wherein:

said suspension system comprises a force exerting device;

said force exerting device, under control of said control device, exerting a force within said suspension system, said force influencing said at least one status variable;

said force exerting device switching into a deactivated mode of operation in response to said malfunction signal; and said force exerting device is adapted to exert, in said deactivated mode of operation, a resetting force within said suspension system, said resetting force acting to reset said wagon body into a predetermined neutral position with respect to said running gear.

10. The rail vehicle according to claim 9, wherein:

said force exerting device comprises an actuator device comprising a tilt actuator adjusting a tilt angle of said wagon body about a tilt axis running in a longitudinal direction of said vehicle;

and/or said force exerting device comprises a damper device comprising a yaw damper device, damping movements between said running gear and said wagon and/or said first reference part and/or said second reference part is integrated into a component of said force exerting device comprising an actuator device of said force exerting device.

11. A method for detecting malfunction in a suspension system of a rail vehicle with a wagon body and a suspension system comprising a running gear supporting said wagon body, said method comprising:

capturing an actual value of at least one status variable, said status variable being representative of a spatial relationship between a first reference part associated to said running gear and a second reference part associated to said wagon body;

performing a malfunction analysis using said actual value of said status variable and at least one predetermined malfunction criterion, said malfunction analysis assessing fulfillment of the at least one predetermined malfunction criterion and considering pre-definable allowable limits of a relative motion between said running gear and said wagon body; and providing a malfunction signal if said malfunction analysis reveals that said malfunction criterion is fulfilled.

12. The method according to claim 11, wherein:

said rail vehicle defines a longitudinal direction, a transverse direction and a height direction; and said status variable being representative: (1) a transverse displacement between said first reference part and said second reference part in said transverse direction, (2) an angular yaw displacement between said first reference part and said second reference part about said height direction, or both (1) and (2).

13. The method according to claim 11, wherein:

an adaptation of said malfunction analysis to an actual running condition of said rail vehicle is provided;

said actual running condition is defined by a running speed of said vehicle and/or a running direction of said vehicle and/or a track geometry of a track currently negotiated by said vehicle; and said track geometry is defined by at least one of a curvature of said track, a superelevation of said track and a torsion of said track.

14. The method according to claim 13, wherein:

an actual value of a running condition variable is captured;

said running condition variable is representative of said actual running condition of said rail vehicle; and (1) said malfunction analysis is executed as a function of said actual value of said running condition variable, or (2) modifying a capturing behavior of said status variable as a function of said actual value of said running condition variable, or both (1) and (2).

15. The method according to claim 1, wherein:

said suspension system comprises a force exerting device;

said force exerting device exerting a force within said suspension system, said force influencing said at least one status variable;

said force exerting device switching into a deactivated mode of operation in response to said malfunction signal, wherein:

said force exerting device is a tilt actuator adjusting a tilt angle of said wagon body about a tilt axis running in a longitudinal direction of said vehicle;

and/or said force exerting device is a yaw damper device, damping movements between said running gear and said wagon body and/or said first reference part and/or said second reference part is integrated into an actuator device of said force exerting device.

* * * * *

UNITED STATES PATENT AND TRADEMARK OFFICE

CERTIFICATE OF CORRECTION

PATENT NO. : 8,761,973 B2
APPLICATION NO. : 13/388117
DATED : June 24, 2014
INVENTOR(S) : Richard Schneider et al.

It is certified that error appears in the above-identified patent and that said Letters Patent is hereby corrected as shown below:

In the Claims

Column 17, Line 9, Claim 10, after "wagon" insert -- body --

Signed and Sealed this
Seventh Day of October, 2014

Michelle K. Lee

Michelle K. Lee
*Deputy Director of the United States Patent and Trademark Office*